US005927496A

United States Patent [19]

Seaton et al.

[11] Patent Number: 5,927,496

[45] **Date of Patent: *Jul. 27, 1999**

[54] SELF HANGING DISPLAY PACKAGE

[75] Inventors: Robert A. Seaton, Madison; Andrew Scott Covert, Prairie Du Sac, both of Wis.

[73] Assignee: Fiskars Inc., Madison, Wis.

[ * ] Notice: This patent is subject to a terminal disclaimer.

[21] Appl. No.: 08/878,395

[22] Filed: Jun. 18, 1997

Related U.S. Application Data

[63] Continuation-in-part of application No. 08/513,069, Aug. 9, 1995., Pat. No. 5,649,624

[51] Int. Cl.[6] ..... B65D 75/00

[52] U.S. Cl. ..... 206/461; 206/806; 220/23.4

[58] Field of Search ..... 206/461–471, 206/806; 211/49.1; 220/23.4

[56] References Cited

U.S. PATENT DOCUMENTS

| | | | |
|---|---|---|---|
| 981,269 | 1/1911 | Hurff . | |
| 1,070,239 | 8/1913 | Ferguson . | |
| 1,738,030 | 12/1929 | Bebb . | |
| 2,273,641 | 2/1942 | Henderson . | |
| 2,629,154 | 2/1953 | Micucci . | |
| 2,698,095 | 12/1954 | Dulle . | |
| 3,157,280 | 11/1964 | Perdue et al. | 206/468 |
| 3,313,407 | 4/1967 | Palm, Jr. . | |
| 3,467,248 | 9/1969 | Makowicki | 206/464 |
| 3,965,600 | 6/1976 | Paskerian | 40/759 |
| 4,034,865 | 7/1977 | Batts et al. . | |
| 4,113,109 | 9/1978 | Donnelli et al. . | |
| 4,210,246 | 7/1980 | Kuchenbecker . | |
| 4,667,827 | 5/1987 | Calcerano . | |
| 5,103,970 | 4/1992 | Nielson et al. . | |
| 5,186,345 | 2/1993 | Ching An . | |
| 5,199,578 | 4/1993 | Pendergraph et al. . | |
| 5,209,354 | 5/1993 | Thornhill et al. . | |
| 5,405,022 | 4/1995 | Rissley . | |
| 5,624,033 | 4/1997 | Arai et al. | 206/467 |
| 5,649,624 | 7/1997 | Seaton | 206/461 |

OTHER PUBLICATIONS do–it Product Sheet.

*Primary Examiner*—Jim Foster
*Attorney, Agent, or Firm*—Foley & Lardner

[57] ABSTRACT

A self-hanging and self-engaging display package includes a rear panel having an aperture formed therein and a front panel having an integrally formed tab. A plurality of display packages form a display package system for automatically forming a chain of a plurality of self-hanging display packages. The tab of a first display package releasably engages the aperture of a second adjacent display package as the first display package is pulled out of the shipping container.

4 Claims, 4 Drawing Sheets

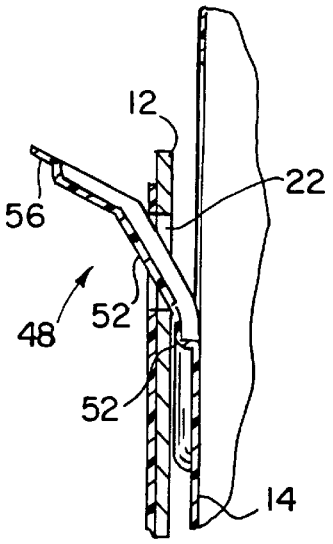
FIG. 6
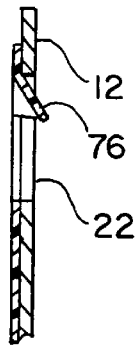
FIG. 7
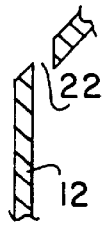
FIG. 8
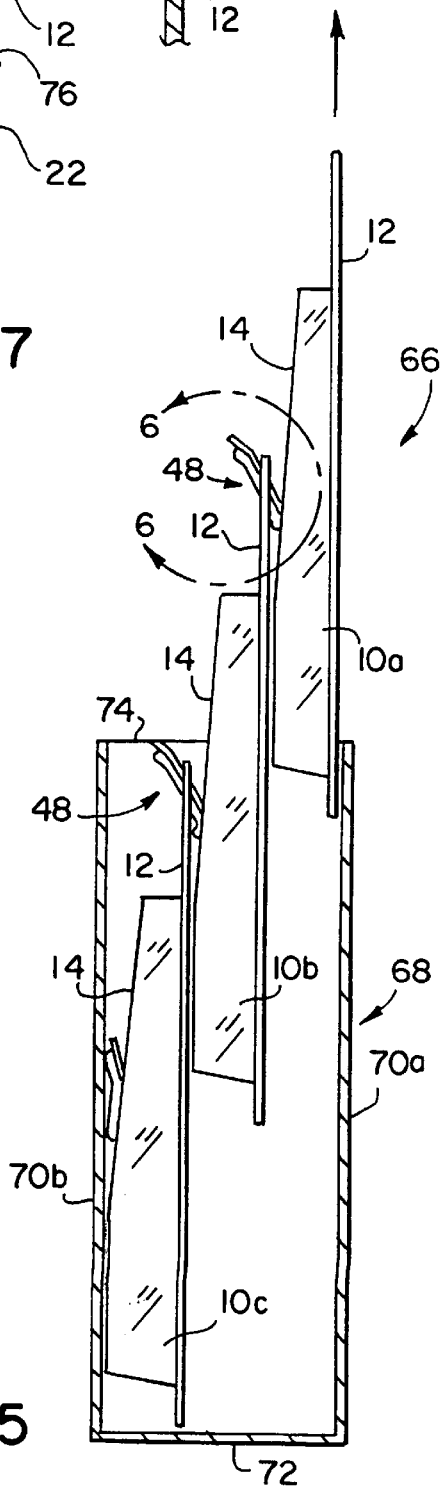
FIG. 5
FIG. 4
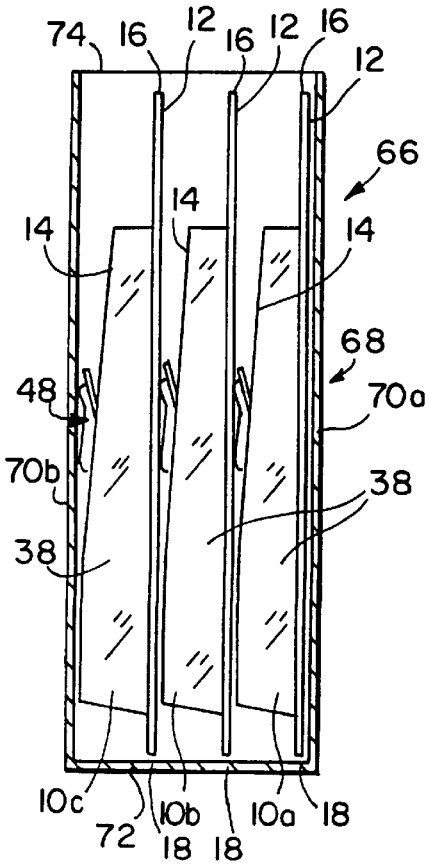

SELF HANGING DISPLAY PACKAGE

RELATED APPLICATIONS

This is a continuation-in-part of U.S. application Ser. No. 08/513,069 filed Aug. 9, 1995 now U.S. Pat. No. 5,649,624.

FIELD OF THE INVENTION

This invention relates to point of purchase display packages and more particularly to a plurality of self-hanging display packages that self-engage as they are withdrawn from a shipping container.

BACKGROUND OF THE INVENTION

Display and presentation of merchandise are important aspects of retail. Accordingly, display packages must be suitable for the effective presentation and marketing of merchandise. Additionally, display packages must be designed to be adaptable to standard fixtures as well as to minimize the labor required by the retailer or jobber to unpack the items. Similarly, display packages must also minimize the labor and materials required to package and ship the products.

Attempts have been made to minimize costs incurred by suppliers, jobbers, and retailers in connection with the packaging, shipping and merchandising of goods in display packages. For example, U.S. Pat. No. 3,313,407 issued Apr. 11, 1967 to Palm Jr. for a "Carton for Storing and Loading Merchandise Display Cards" discloses a shipping carton configured to permit the display packages to be loaded directly onto a horizontal hanger. This device however requires a specially constructed shipping container, and is limited to unloading display packages on a horizontal hanger of a particular configuration.

Another way to reduce the labor required at store level to display packaged merchandise is disclosed in U.S. Pat. No. 5,103,970 issued Apr. 14, 1992 to Nielson et al. for a "Collapsible Display System". Nielson discloses an elongated plastic strip having a series of tabs which hold display items. This device permits display packages to be delivered to the store pre-loaded onto the strip thereby reducing in-store handling labor. However, the display packages must still be loaded onto the strip by the supplier or jobber prior to being shipped to the store. Furthermore a strip of a particular configuration is required to receive the products and secure them during shipment.

Another important aspect of product merchandising is the amount of shelf space required to display the products. Various attempts have been made to maximize sales per square footage of display. In particular U.S. Pat. No. 1,070,239 issued Aug. 12, 1913 to Ferguson for a "Display Frame" discloses a plurality of display frames for displaying post cards or magazines. Each display includes an aperture located at the top of the display frame and a catch extending rearward from the bottom of the display frame. A chain of display frames is created by hanging aperture of a display frame onto catch of a previously hung display frame. However, merchandise must still be this loaded on to the device, and a supply of display frames must be maintained at the retail outlet. Further this device requires the manual construction of the hanging fixture.

Attempts have also been made to integrate a hanging feature within the display package itself. For example, U.S. Pat. No. 4,113,109 issued Sep. 12, 1978 to Donnelli et al. for a "Merchandising System For Use With Perforated Panels Or The Like" which discloses a display package formed with an attaching portion. This attaching portion permits a first package to hang directly to a perforated panel, and subsequent packages to hang directly in front of a preceding package. However, this approach requires the manual stacking of the packages and is limited to stacking horizontally.

The foregoing makes apparent that the limitations of prior art display packages and systems have not been completely satisfactorily addressed. It is therefore desirable to provide a display package that permits efficient use of shelf-space, and that is configured to minimize in store labor.

SUMMARY OF THE PRESENT INVENTION

A display package in accordance with one aspect of the present invention comprises a rear panel and a front panel extending over at least a portion of the rear panel. The rear and front panels being connected to one another. The front panel having a top edge and a bottom edge opposite the top edge. The front panel also includes a tab attached to the front panel and extends in a direction away from the rear panel toward the top edge In accordance with another aspect of the invention the tab is formed integrally with the front panel. Yet another aspect of the display package includes a scoop proximate the aperture and extending from the rear panel.

Another aspect of this invention includes a display package for displaying an item having a panel having a top edge and an opposing bottom edge. The display package also includes a tab attached to the front panel and extending away from the panel and toward the top edge. The display package further includes a means for securing the item to the panel.

Another aspect of this invention includes a plurality of interconnected display packages. Each display package includes a rear panel and a front panel extending at least over a portion of the rear panel and being connected thereto. The front panel having a top edge and a bottom edge opposite the top edge. One of the front panel and rear panel has an aperture. Each display package further includes a tab attached to at least one of the rear and front panel and extending from the panel toward the top edge. Each tab is configured to engage the aperture of an adjacent display package.

According to a further aspect of this invention each package includes a scoop proximate the aperture to facilitate engagement with the tab of an adjacently disposed package.

According to yet another aspect of this invention a display package system comprises a plurality of display packages capable of being interconnected. Each display package includes a panel having a top edge and a bottom edge opposite thereto. Each display package further includes a tab attached to the front panel and extends away from the panel and toward the top edge. Each tab is configured to engage a display package disposed adjacent thereto.

Another aspect of this invention includes a method for hanging a plurality of display packages from one another as they emerge from a shipping container. The method comprising the steps of first lifting a first display package from a shipping container holding a plurality of display packages. Another step includes engaging the aperture of a display package adjacent the first display package with the tab of the first display package. A further step includes hanging the adjacent display package from the tab of the first display package. Yet, another step includes continuing to lift the first display package and engaging the aperture of subsequent adjacent display packages from the tab of last to be engaged display package until all of the display packages are pulled out of the shipping container.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and:

FIG. 4 is a schematic view of the display packages within the shipping container;

FIG. 5 is a schematic view of the display packages being pulled out of the shipping container;

FIG. 6 is a enlarged view of area 6—6 of FIG. 5;

FIG. 7 is a fragmentary view of an alternative embodiment of the aperture in a display package;

FIG. 8 is a fragmentary view of another alternative embodiment of the rear panel and aperture in a display package;

DETAILED DESCRIPTION

Figure 1:
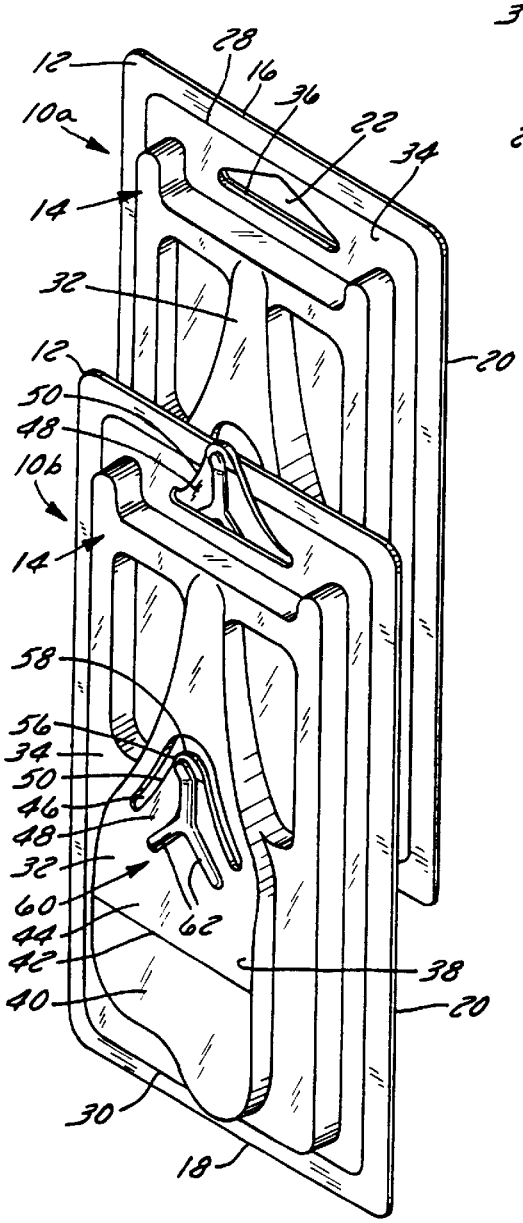
FIG. 1 is an isometric view of the display package system of the present invention.
Figure 2:
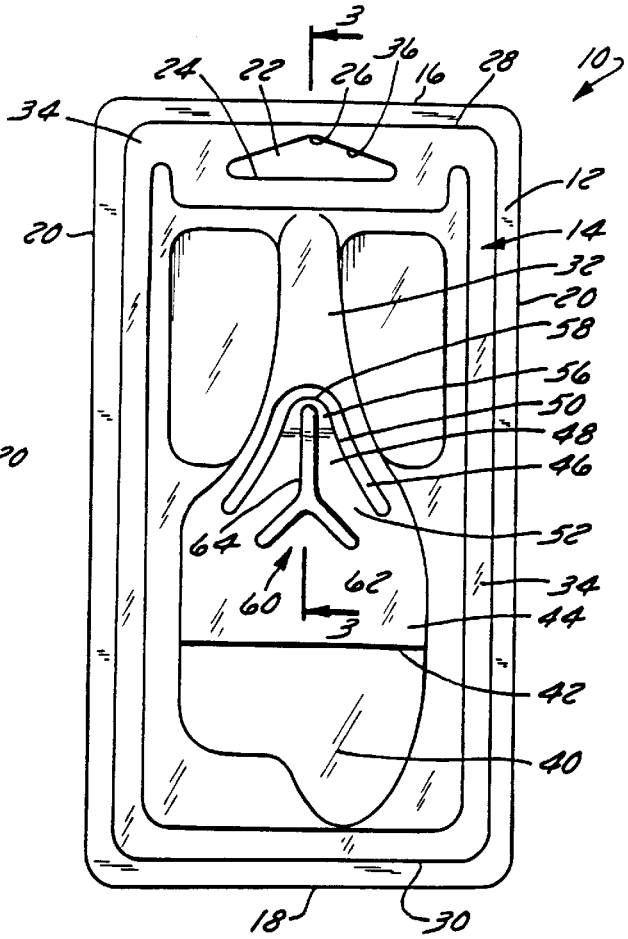
FIG. 2 is a front elevation view of the display package of the present invention.
Figure 3:
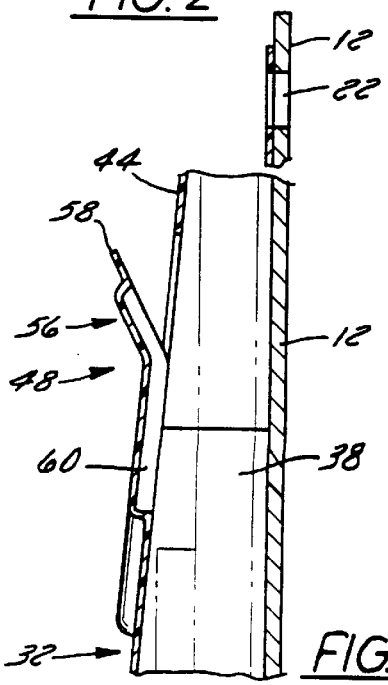
FIG. 3 is a cross-sectional view taken generally along line 3—3 of FIG. 2.

Referring to FIGS. 1–3 a detailed description of an exemplary display package 10 will be described. Display package 10 includes a rear panel 12, and a front panel 14 attached thereto. Rear panel 12 includes a top margin 16, a bottom margin 18, and a pair of side margins 20. Rear panel 12 further includes an aperture 22 proximate top margin 16. In the preferred embodiment aperture 22 has a generally triangular shape having a base 24 and an apex 26. Rear panel 12 may be constructed of cardboard, however rear panel 12 may be constructed of other suitable materials such as plastic.

Front panel 14 includes a top edge 28, a bottom edge 30, a raised portion 32 and a base portion 34. Base portion 34 is preferably adhesively attached to rear panel 12. Base portion 34 of front panel 14 includes an opening 36 in substantial alignment with aperture 22 of rear panel 12. A cavity 38 is formed between rear panel 12 and raised portion 32 of front panel 14. Merchandise is contained within cavity 38. Front panel 14 may be constructed of a transparent material such as plastic allowing for display of the merchandise contained within cavity 38. In this manner a package commonly known as a "blister package" is formed including a clear plastic front panel or "blister" which is attached to a rear panel backing material.

In the exemplary embodiment, raised portion 32 includes a first region 40 originating proximate bottom edge 30 of front panel 14 and extending a given distance toward top edge 28 of front panel 14 and terminating at a line 42. The distance between rear panel 12 and first region 40 is substantially uniform. Raised portion 32 further includes an inclined region 44 originating at line 42 contiguous with first region 40 and extending toward top edge 28. The distance between inclined region 44 and rear panel 12 is equivalent to the distance between rear panel 12 and first region 40 at line 42 and then decreases at a uniform rate.

Raised portion 32 includes an inverted generally "U" shaped slot or opening 46 intermediate top edge 28 and bottom edge 30. In the exemplary embodiment, slot 46 is located within inclined region 44 intermediate top edge 28 and line 42. Slot 46 defines a tab 48 integrally formed with raised portion 32. Tab 48 preferably includes a symmetrical tab edge 50 and a tab base 52. Tab base 52 has a width substantially the same as the width of aperture 22. Tab 48 further includes a crease 54 and a tip 56 extending therefrom. Tip 56 extends upward and away from raised portion 32, outwardly from cavity 38 as illustrated in FIG. 6. Tip 56 has a height approximately equal to the apex 26 of aperture 22, and includes a tip end 58. In the preferred embodiment, tip end 58 extends above first region 40 by approximately 1/16 inches, and extends above inclined region 44 approximately 3/16 inches.

Tab 48, preferably, further includes an inverted "Y" shaped rib 66 integrally formed in raised portion 32. Rib 60 includes a pair of legs 62 extending from tab 48 into raised portion 32 and a top leg 64 extending toward tip end 58. However, rib 60 may have other configurations such as a "U" or an "1" shape. In the preferred embodiment, rib 60 has a convex shape having a width of approximately 1/8 inch and a height of approximately 1/16 inch. Tab 48 is flexible and resilient, such that when tab 48 is depressed toward rear panel 12, it will return to its set position upon release. In this manner tab 48 acts as a spring.

Referring again to FIG. 1, a display package system 66 including a plurality of display packages 10 will be described. First a self-hanging feature of the display package system will be described. A first display package 10*a* is releasably suspended from aperture 22 on a fixture (not shown) such as a hook or a rod. A second display package 10*b* is releasably suspended from first display package 10*a* by engagement of tab 48 of first display package 10*a* with an aperture 22 of second display package 10*b*. As tab 48 engages aperture 22, tab edge 50 in cooperation with aperture 22 acts to center second display package 10*b* as it comes to rest at the base of slot 46. Additional display packages 10 are supported in this manner forming a vertical chain of display packages in which each display package is suspended by a previously hung display package 10. In this manner display packages 10 are self-hanging and do not require any additional strip or external support.

Referring to FIGS. 4–6 a self-engagement feature of the display package system 66 will now be described. A plurality of display packages 10*a,* 10*b* and 10*c* are illustrated packed in shipping container 68. Shipping container 68 includes a pair of sides 70*a* and 70*b,* a bottom 72, and a top 74.

As illustrated in FIG. 4, display packages 10*a,* 10*b,* and 10*c* are similarly positioned such that each top margin 16 of rear panel 12 is proximate top 74 of shipping container 68. Further, each rear panel 12 and front panel 14 are positioned, such that each rear panel 12 is closer to shipping container side 70*a,* and each front panel 14 is closer to shipping container side 70*b*. In this way rear panel 12 of first display package 10*a* is adjacent shipping container side 70*a*. Further, rear panel 12 of second display package 10*b* is adjacent front panel 14 of first display package 10*a*. Similarly, rear panel 12 of third display package 10*c* is adjacent front panel 14 of second display package 10*b*. As illustrated, front panel 14 of third display package 10*c* is adjacent shipping container side 70*b*.

In this packed position, each tab 48 is flexed inward toward cavity 38 by the adjacent rear panel 12. As a result tip 56 is depressed inward toward cavity 38. For example, rear panel 12 of second display package 10*b* presses against tip 56 of first display package 10*a* thereby flexing tab 48 inward toward cavity 38. In this position, the spring characteristic of tab 48 of first display package 10*a* results in tip 56 exerting a force against rear panel 12 of second display package 10*b*.

As first display package 10*a* is pulled out of or lifted from shipping container 68, the spring force of tab 48 causes tip 56 of first display package 10*a* to positively engage within aperture 22 of second display package 10*b*. As first display package 10*a* continues to be pulled from shipping container 68, tab 48 fully engages aperture 22 of second display package 10*b*. Tab 48 of second display package 10*b* will then engage aperture 22 of third display package 10*c*. In this manner all of the display packages 10*a,* 10*b* and 10*c* within shipping container 68 will self-engage and form a vertical chain of display packages.

The self-engagement of display packages 10*b* and 10*c* may be facilitated by simultaneously moving first display package 10*a* in a direction toward second container edge 70*b* as first display package 10*a* is being pulled out of shipping container 68. In this manner inclined region 44 permits display packages to pivot about line 42 to better position tab 48 to facilitate engagement of aperture 22 of the adjacent display package.

Although FIGS. 4 and 5 illustrate three display packages 10*a,* 10*b* and 10*c,* a greater number of display packages may be packed in shipping container 68. In this embodiment, a vertical chain of 10 display packages containing scissors may be formed. The number of display packages which may be packed within shipping container 68 is limited by the strength of tab 48 and the weight of the merchandise held within cavity 38 of display package 10.

In an alternative embodiment as illustrated in FIG. 7, front panel 14 includes a scoop 76 which extends through rear panel aperture 22. Scoop 76 facilitates the engagement of tab 48 with aperture 22. Scoop 76 may have the form of an angled member or may have a curved surface. As a first display package is pulled out of shipping container 68, tab 48 engages scoop 76 which then guides tab 48 through aperture 22. In this manner scoop 76 facilitates the engagement of tab 48 of a first display package with the aperture 22 of a second display package. Accordingly, in this alternative embodiment, tab 48 may be flexible and resilient as in the exemplary embodiment, or tab 48 may rigidly extend from front panel 14 in a direction away from cavity 38. Alternatively, as illustrated in FIG. 8, rear panel 12 may be angled rearwardly away from cavity 38 proximate top margin 16.

Figure 9:
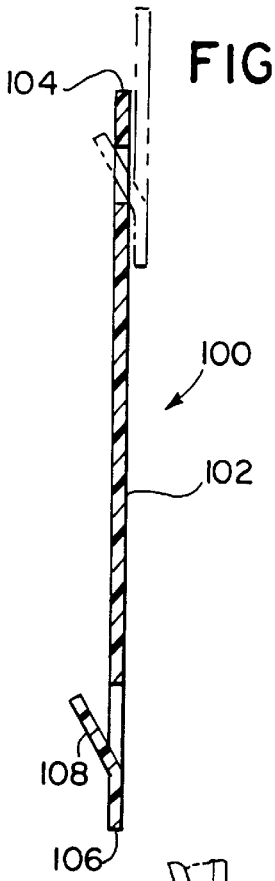
FIG. 9 is a cross-sectional view of another alternative embodiment of a single panel display package having an integrally formed tab and an aperture therethrough.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims:

For example, as illustrated in FIG. 9, in an alternative embodiment display package 100 is formed of a single panel 102 having a top edge 104 and a bottom edge 106 opposite thereto. Display package 100 further includes a tab 108 attached to the panel 102 and extends therefrom away from panel 102 and toward top edge 104. An item to be displayed would be secured to panel 102 by a mechanical farstner such as wire, or by an adhesive. The item could further be secured to panel 102 by a flexible or rigid member attached to panel 102.

Figure 10:
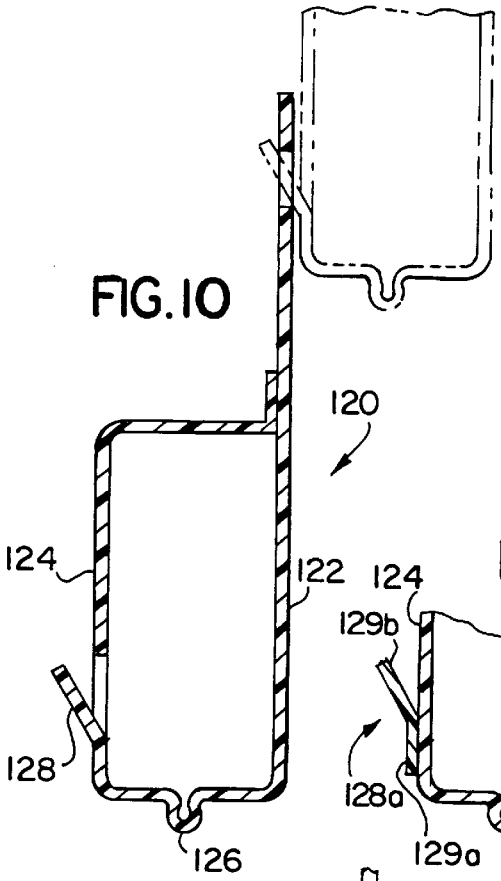
FIG. 10 is a cross-sectional view of a further alternative embodiment of a display package having a front panel and a rear panel in an integrally formed clamshell.

Additionally, as illustrated in FIG. 10 a display package 120 includes a rear panel 122 and a front panel 124 as integrally formed clamshell, whereby rear panel 122 and front panel 124 are integrally formed along a common edge or living hinge 126. A tab 128 is integrally formed in the clamshell.

In this embodiment it is possible to include an integrally formed releasable lock to permit the display package to be opened and securably closed. A number of methods for releasably locking the front panel and rear panel together are known in the art.

Figure 11:
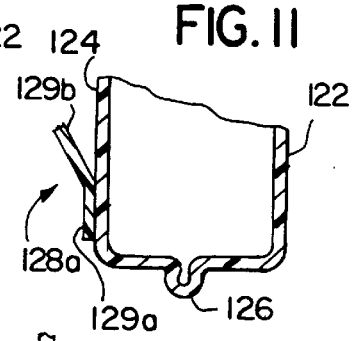
FIG. 11 is a fragmentary cross-sectional view of an alternative embodiment of a tab attached to a display package.

As illustrated in FIG. 11 a tab 128*a* may also be a separate member secured to the front panel 124 by adhesive or other mechanical fasteners. A separate tab could replace the integrally formed tab elements described herein in connection with the other display package configurations. In one embodiment the separate tab member is formed of a first portion connected to the package and of a second portion including a tab or post extending from the first portion. The first portion may include an adhesive backing for attachment to the package. The tab is formed of a material to permit the second or tab portion to extend upward and away from the first portion. In this manner when the first portion is attached to the package the tab would extend away from the package. The tab may be formed of a flexible and resilient material, such that when the tab is depressed toward the package to which the first portion is attached, the tab will return to its set position upon release. In this manner the tab portion would act as a spring. The separate attachable tab could also include the structural features described above in connection with tab 48. The second tab portion could also include a post having a cylindrical shape. Of course the tab portion may have other shapes as well.

Figure 12:
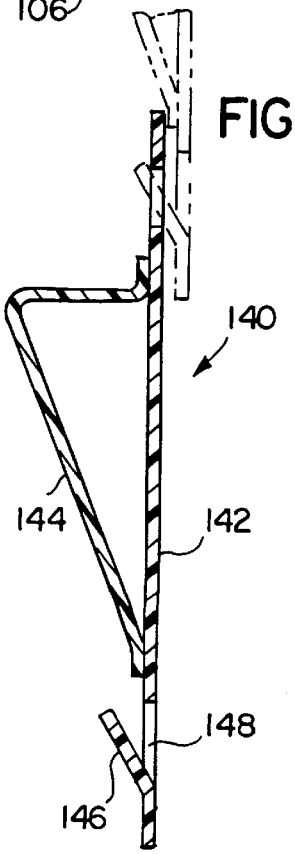
FIG. 12 is a cross-sectional view of a display package including a front panel and a rear panel having a tab integrally formed therewith and an aperture formed therethrough.
Figure 14:
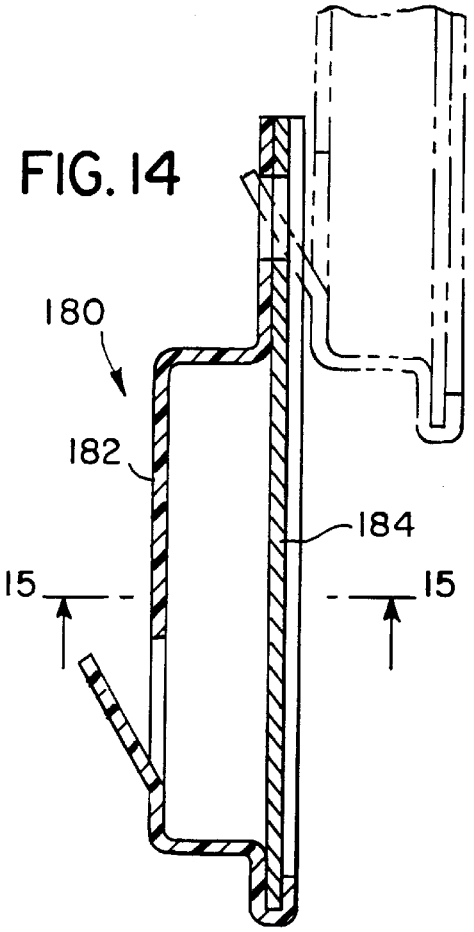
FIG. 14 is still another alternative embodiment of a display package having a first panel and a second panel slidably attached thereto.

Further, in another embodiment illustrated in FIG. 12, display package 140 includes a rear panel 142 and a front panel 144. Rear panel 142 includes a tab 146 integrally formed thereto and an aperture 148 formed therethrough adjacent tab 146. However, the tab and aperture need not be located in the same panel. It is also possible for the tab to be attached to the front panel and the aperture to be formed in the rear panel. (See FIG. 10). Similarly, the tab may be attached to the rear panel and the aperture may be formed in the front panel. Or as illustrated in FIG. 14, the aperture may be formed in both the front and rear panels.

Figure 13:
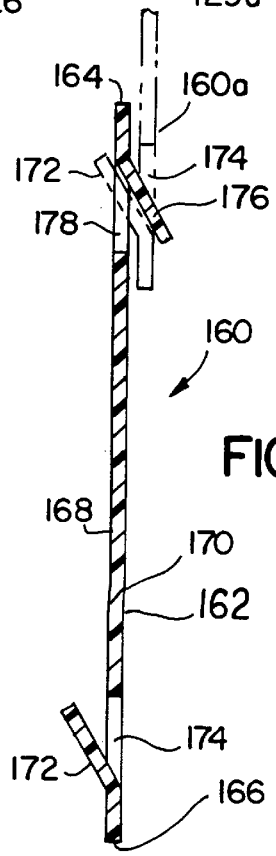
FIG. 13 is an alternative embodiment of a single panel display package having a tab and a scoop opposite thereto.

In still another embodiment illustrated in FIG. 13 a display package 160 is formed of a single panel 162 having a top edge 164, a bottom edge 166, a front face 168 and a rear face 170. Panel 162 includes a first tab 172 integrally formed therewith proximate bottom edge 166 and extending away from front face 168 in a direction distal rear face 170 and toward top edge 164. A first aperture 174 is formed through panel 162 proximate first tab 172. Panel 162 includes a second tab 176 integrally formed therewith proximate top edge 164 and extending away from rear face 170 and toward bottom edge 166. A second aperture 178 is formed through panel 162 proximate second tab 176.

As illustrated in FIG. 13 in dashed lines a second display package 160*a* similar to display package 160 in all respects and identified with similar reference numerals may be attached to display package 160 by engagement of the first tab of second display package 160*a* through second aperture 178 of display package 160 and simultaneous engagement of second tab 176 of display package 160 though the first aperture of second display package 160*a*.

The self engaging feature of display panel 160 would require first and second tabs 172, 176 to have a length greater than first and second apertures 174, 178 respectively to prevent tabs 172, 176 of one panel from engaging apertures 174, 178 respectively of an adjacent panel.

Figure 15:
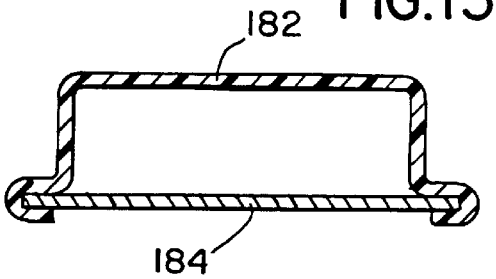
FIG. 15 is a cross-sectional view taken generally along line 15—15 of FIG. 14.

Additionally, in an alternative embodiment illustrated in FIGS. 14 and 15, a display package 180 includes a front panel 182 and a rear panel 184 slidably attached thereto.

Figure 17:
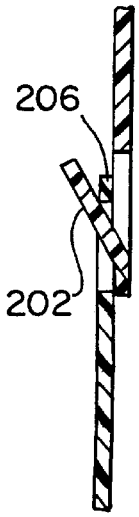
FIG. 17 is a cross-sectional view taken generally along line 17—17 of FIG. 16.
Figure 16:
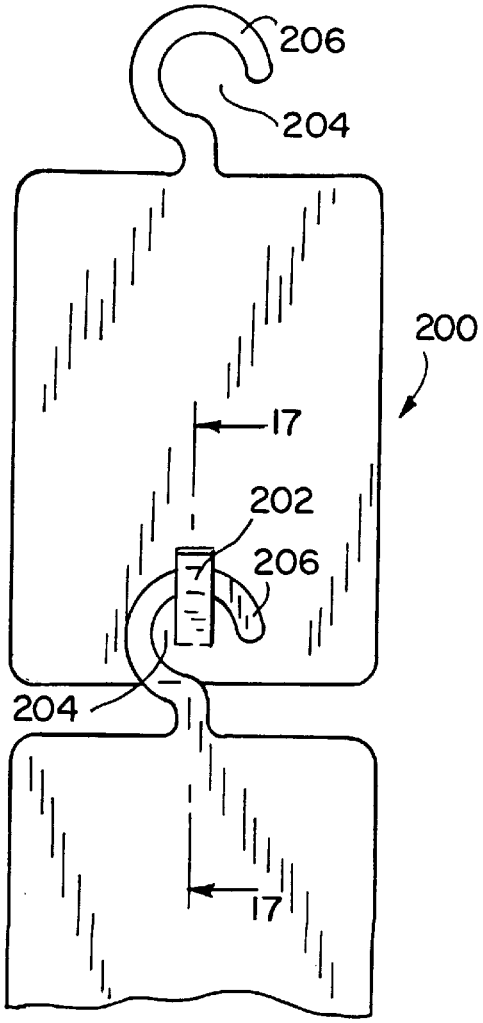
FIG. 16 is a plan view of an alternative embodiment of a display package tab and hook.

In still another embodiment illustrated in FIGS. 16 and 17 a display package 200 includes a tab 202 which engages an opening 204 formed by a hook shaped member 206. Hook shaped member may be a separate member adhesively or otherwise attached to display package 200. Similarly, tab 202 may be either integrally formed with display packaged adhesively or otherwise attached thereto.

Further, in general tab 48 may include a crease at its base, such that the entire tab 48 is formed to angle out from front panel 14. Tab 48 may also be a separate member attached to front panel 14. Also, aperture 22 may have various shapes, such as rectangular or oval. Additionally, scoop 76 may be integrally formed with rear panel 12 or attached thereto. Aperture 22 may be formed solely within rear panel 12 such that when a second display package is suspended from a first display package, tab 48 does not extend through front panel 14 of the first display package 10. These other configurations and constructions are considered to be within the scope of the present invention. Thus, these and other substitutions and modifications may be made in the design and arrangement of elements disclosed herein without departing from the scope of the appended claims.

What is claimed is:

1. A display package comprising:

a rear panel;

a front panel extending over at least a portion of the rear panel and being connected thereto, the front panel further having a top edge and a bottom edge opposite thereto, at least one of the front panel and rear panel including an aperture formed therein; and a tab attached to the front panel and extending therefrom away from the rear panel toward the top edge wherein each tab is configured to engage another display package disposed adjacent thereto and the rear panel includes a scoop proximate the aperture, extending away from the rear panel in a direction toward the bottom edge.

2. A display package system, comprising a plurality of interconnected display packages, each display package comprising:

a rear panel;

a front panel extending at least over a portion of the rear panel and being connected thereto, the front panel further having a top edge and a bottom edge opposite thereto, one of the front panel and rear panel having an aperture therethrough; and a tab attached to at least one of the rear panel and front panel and extending therefrom toward the top edge;

wherein each tab is configured to engage the aperture of a display package disposed adjacent thereto.

3. A method for hanging a plurality of display packages from one another as they emerge from a shipping container, comprising the steps of:

lifting a first display package from a shipping container holding a plurality of display packages, wherein each display package includes a rear panel, a front panel extending at least over a portion of the rear panel and being connected thereto, at least one of the front panel and rear panel having an aperture therethrough, and a tab attached to at least one of the front panel and rear panel extending therefrom;

engaging the aperture of a second display package adjacent the first display package with the tab of the first display package as the first display package is lifted from the container; and successively engaging remaining display packages as the first display package continues to be lifted away from the container.

4. A method for hanging a plurality of display packages from one another as the packages emerge from a shipping container, comprising the steps of:

lifting a first display package from a shipping container holding a plurality of display packages, wherein each display package includes a panel having an aperture therethrough, and a tab attached to the panel and extending therefrom;

engaging the aperture of a second display package adjacent the first display package with the tab of the first display package as the first display package is lifted from the container; and successively engaging remaining display packages as the first display package continues to be lifted away from the container.

* * * * *